US007003988B2

(12) United States Patent
Yu

(10) Patent No.: US 7,003,988 B2
(45) **Date of Patent: *Feb. 28, 2006**

(54) NUMERAL LOCK HOUSING STRUCTURE

(76) Inventor: Chun-Te Yu, No. 41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/923,040

(22) Filed: Aug. 23, 2004

(65) Prior Publication Data

US 2005/0044902 A1 Mar. 3, 2005

Related U.S. Application Data

(62) Division of application No. 10/679,425, filed on Oct. 7, 2003.

(30) Foreign Application Priority Data

Aug. 28, 2003 (TW) ..... 92215596 U

(51) Int. Cl.
*E05B 37/06* (2006.01)

(52) U.S. Cl. ..... 70/25; 70/30; 70/312

(58) Field of Classification Search ..... 70/22–30, 70/312–316

See application file for complete search history.

(56) References Cited

U.S. PATENT DOCUMENTS

| | | | | |
|---|---|---|---|---|
| 4,803,856 | A * | 2/1989 | Ling | 70/28 |
| 5,396,785 | A * | 3/1995 | Chen | 70/25 |
| 5,918,489 | A * | 7/1999 | Yang | 70/28 |
| 6,363,758 | B1 * | 4/2002 | Ling | 70/30 |
| 6,470,717 | B1 * | 10/2002 | Yu | 70/25 |
| 6,880,370 | B1 * | 4/2005 | Yu | 70/25 |
| 2004/0226323 | A1 * | 11/2004 | Ling et al. | 70/25 |

* cited by examiner

*Primary Examiner*—Suzanne Dino Barrett
(74) *Attorney, Agent, or Firm*—Troxell Law Office, PLLC

(57) ABSTRACT

A numeral lock housing structure including a lock housing composed of two halves mated with each other. Each of the halves is formed with at least one lateral face and a front face forward extending from the lateral face. Two edges of the front faces form two mating edges mated with each other. A corner section between the lateral face and the front face of at least one of the two halves is formed with at least one numeral wheel window. At least one numeral wheel is mounted in the numeral wheel window for controlling a lock bolt to lock/unlock the numeral lock. The numeral wheel window extends into the front face without crossing the mating edge thereof. Therefore, the mating edges of the two halves of the lock housing will not be slotted so that the structure of the front face of the lock housing is kept integrated. The numeral wheel is positioned between the lateral face and front face so that the numeral wheel has larger turning angle each time the numeral wheel is turned.

4 Claims, 3 Drawing Sheets

NUMERAL LOCK HOUSING STRUCTURE

This application is a Division of currently pending application U.S. Ser. No. 10/679,425, entitled "NUMERAL LOCK HOUSING STRUCTURE" and filed on Oct. 7, 2003.

BACKGROUND OF THE INVENTION

The present invention is related to an improved numeral lock housing structure in which the numeral wheel window is re-designed and formed between the lateral face and front face of the lock housing. The numeral wheel window extends into the front face without crossing the mating edge thereof. Therefore, the mating edges of the two halves of the lock housing will not be slotted so that the structure of the front face of the lock housing is kept integrated. In addition, the numeral wheel is positioned in the corner between the lateral face and front face so that the numeral wheel has larger turning angle each time the numeral wheel is turned.

FIG. 1 shows a conventional numeral lock. Several numeral wheel windows 13 are formed on a lateral face 12 of the lock housing 11. Several numeral wheels 10 are disposed in the windows 13. The mating edges 15 of the front faces of the lock housing 11 are not interrupted by the windows 13. Therefore, the front faces of the lock housing 11 is integrated and is not subject to damage of alien article or external force. However, the numeral wheels 10 are presented only on single lateral face of the lock housing 11. Therefore, the numeral wheel has greatly limited turning angle each time the numeral wheel is turned. As a result, it is necessary to many times turn the numeral wheel for unlocking the numeral lock. This is quite inconvenient.

FIG. 2 shows another type of conventional numeral lock. The numeral wheels 10 are directly bridged over the front face 16 of the lock housing 11 between two lateral faces 12 thereof. Therefore, the mating edges 15 of the lock housing 11 are interrupted. Accordingly, the structural strength of the lock housing 11 is weakened. Also, an alien piece can be easily extended into the lock housing 11 to damage the same. In addition, the numeral wheels 10 are apt to be collided and damaged. As a result, the strength and reliability of the numeral lock as a whole are poor. However, the numeral wheel 10 has larger turning angle each time the numeral wheel 10 is turned so that the operation of the numeral lock is facilitated.

FIG. 3 shows still another type of conventional numeral lock. Several numeral wheel windows 17 are formed on the front face 14 of the lock housing 11 corresponding to the numeral wheels 10. Such numeral wheel windows 17 facilitate identification of the unlocking number of the numeral wheels 10. However, the mating edges 15 of the lock housing 11 are interrupted and the structural strength of the lock housing 11 is weakened. In addition, the numeral wheel 10 has small turning angle each time the numeral wheel 10 is turned.

SUMMARY OF THE INVENTION

It is therefore a primary object of the present invention to provide an improved numeral lock housing structure including a lock housing composed of two halves mated with each other. Each of the halves is formed with at least one lateral face and a front face forward extending from the lateral face. A corner section between the lateral face and the front face of at least one of the two halves is formed with at least one numeral wheel window. The numeral wheel window extends into the front face without crossing the mating edge thereof. Therefore, the mating edges of the two halves of the lock housing will not be interrupted so that the structure of the front face of the lock housing is kept integrated.

It is a further object of the present invention to provide the above numeral lock housing structure in which the numeral wheel window is bridged between the lateral face and the front face of the lock housing so that the numeral wheel is positioned between the lateral face and the front face. Therefore, the numeral wheel has larger turning angle each time the numeral wheel is turned so that the operation of the numeral lock is facilitated.

The present invention can be best understood through the following description and accompanying drawings wherein:

DETAILED DESCRIPTION OF THE PREFERRED EMBODIMENT

Figure 1A:
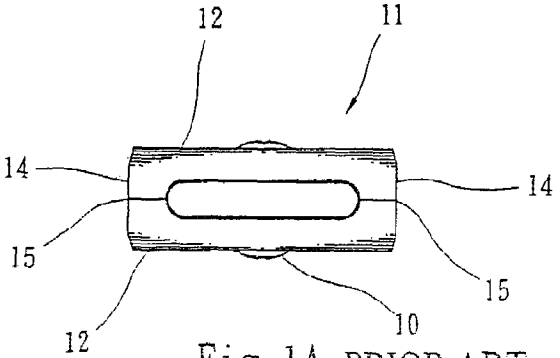
Fig. 1A PRIOR ART
FIG. 1A is a top view according to FIG. 1.
Figure 1:
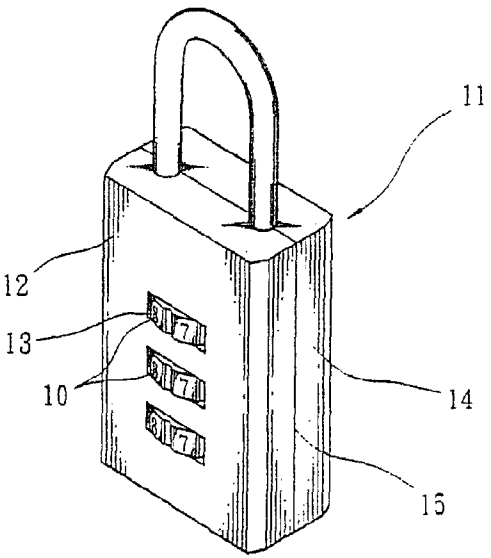
Fig. 1 PRIOR ART
FIG. 1 is a perspective view of a first type of conventional numeral lock.
Figure 2A:
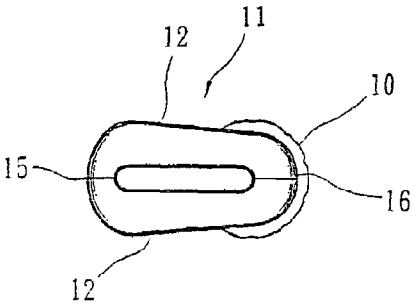
Fig. 2A PRIOR ART
FIG. 2A is a top view according to FIG. 2.
Figure 2:
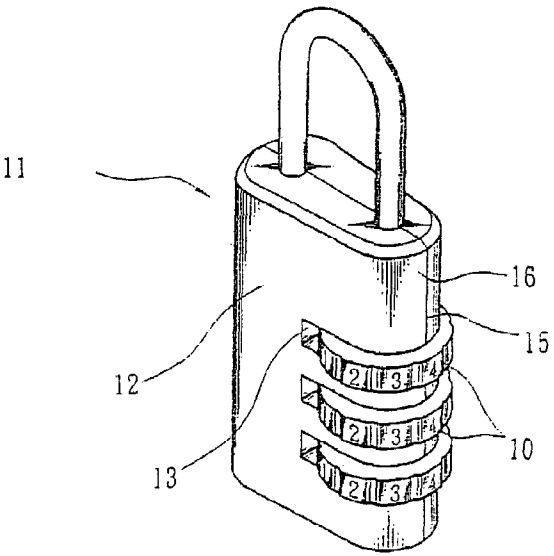
Fig. 2 PRIOR ART
FIG. 2 is a perspective view of a second type of conventional numeral lock.
Figure 4A:
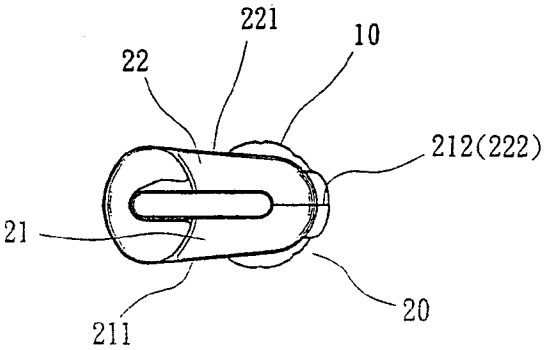
FIG. 4A is a top view according to FIG. 4.
Figure 4:
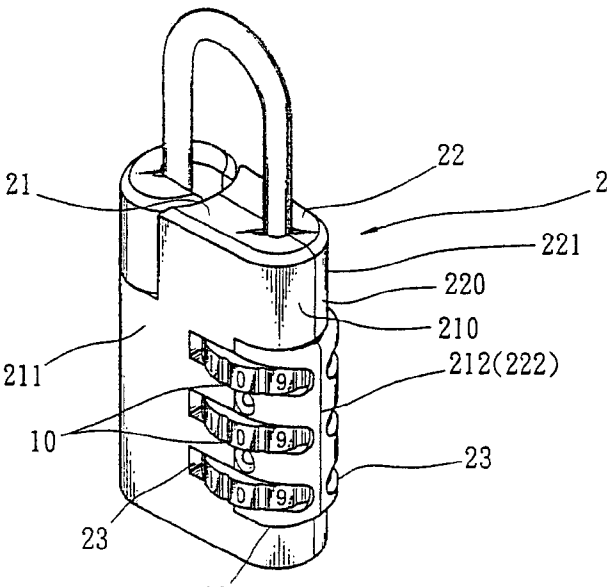
FIG. 4 is a perspective view of a preferred embodiment of the present invention.
Figure 3A:
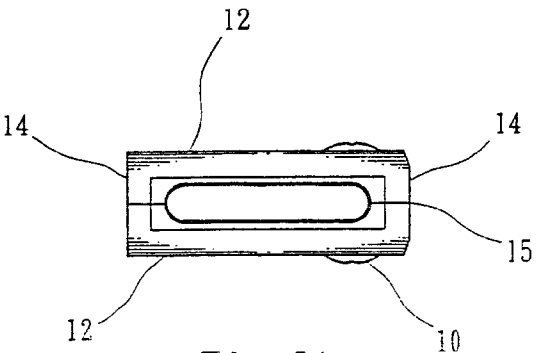
Fig. 3A PRIOR ART
FIG. 3A is a top view according to FIG. 3.
Figure 3:
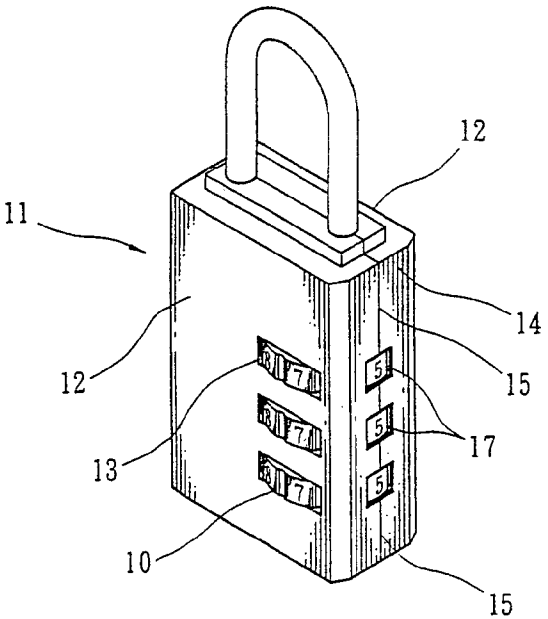
Fig. 3 PRIOR ART
FIG. 3 is a perspective view of a third type of conventional numeral lock.
Figure 5:
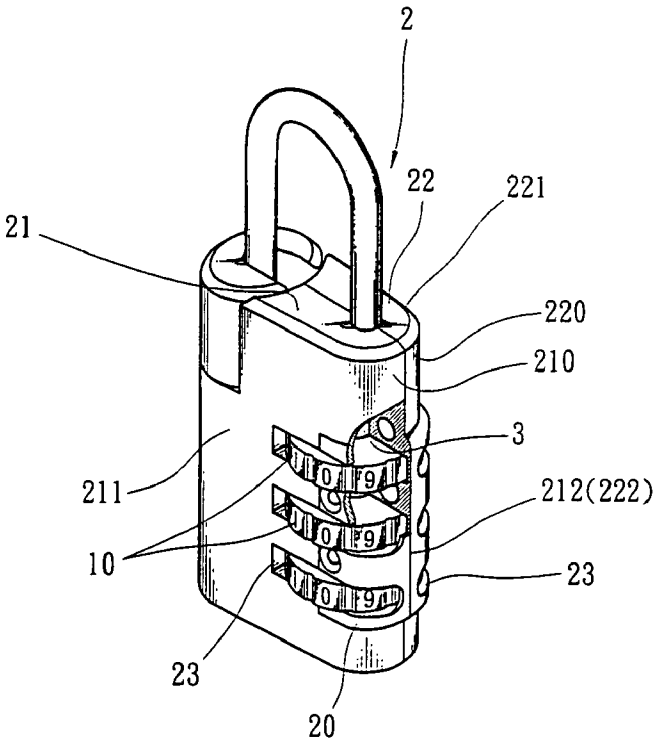
FIG. 5 is a partially sectional perspective view of the preferred embodiment of the present invention.

Please refer to FIGS. 4, 4A and 5. The present invention includes a lock housing 2 composed of two halves 21, 22 mated with each other. Each half 21, 22 is formed with at least one lateral face 211, 221 and a front face 210, 220 forward extending from the lateral face. Two edges 212, 222 of the front faces 210, 220 form two mating edges 212, 222 mated with each other.

A corner section 20 between the lateral face 211, 221 and the front face 210, 220 of at least one of the two halves 21, 22 is formed with at least one numeral wheel window 23. At least one numeral wheel 4 is mounted in the numeral wheel window 23 for driving a lock bolt 3 disposed in the lock housing 2. The numeral wheel 4 can be turned from outer side of the lock housing 2 to drive the lock bolt 3. The lock bolt 3 controls a locking/unlocking unit to lock or unlock the numeral lock.

The numeral wheel window 23 is bridged between the lateral face 211, 221 and the front face 210, 220. In addition, the numeral wheel window 23 extends into the front face 210, 220 without crossing the mating edges 212, 222. That is, the end of the numeral wheel window 23 will not cross and interrupt the mating edges 212, 222 of the two halves 21, 22. Therefore, the strength of the entire lock housing 2 is integrated without being obstructed. Also, no gap is formed between the mating edges 212, 222 so that it is hard for an unauthorized person to extend an alien piece into the seam to damage the lock housing 2. Accordingly, the reliability of the numeral lock is enhanced.

Furthermore, the numeral wheel window 23 is positioned in the corner between the lateral face 211, 221 and the front face 210, 220. Therefore, the numeral wheel 4 mounted in the numeral wheel window 23 has larger turning angle to outer side. Accordingly, each time the numeral wheel 4 is turned, the numeral wheel 4 can be turned by a larger angle. Therefore, the operation of the numeral lock is facilitated. In contrast, in the conventional numeral lock, the numeral wheel 4 is presented only on single face and the turning angle of the numeral wheel 4 is apparently insufficient.

According to the above arrangement, the lock housing of the present invention has reliable strength and it is convenient to operate the numeral lock.

The above embodiment is only used to illustrate the present invention, not intended to limit the scope thereof. Many modifications of the above embodiment can be made without departing from the spirit of the present invention.

What is claimed is:

1. A numeral lock housing structure comprising:

a) a lock housing having two housing halves, each of the two housing halves having:

i) a lateral face;

ii) a front face extending forward from the lateral face and having a mating edge located on an edge opposite the lateral face, the mating edge of a first of the two housing halves aligning with and mated to with the mating edge of a second of the two housing halves;

iii) a corner section located between the lateral face and the front face; and iv) at least one numeral wheel window located in the corner section of at least one of the two housing halves, each of the at least one numeral wheel window being spaced apart from the mating edge of both of the two housing halves; and b) at least one numeral wheel mounted in each of the at least one numeral wheel window and moving a locking mechanism in the housing between locked and unlocked positions.

2. The numeral lock housing structure according to claim 1, further comprising a lock bolt connected to the at least one numeral wheel and controlling the locking mechanism.

3. The numeral lock housing structure according to claim 1, wherein the at least one numeral wheel window includes a plurality of numeral wheel windows symmetrically located in the corner section of each of the two housing halves.

4. The numeral lock housing structure according to claim 2, wherein the at least one numeral wheel window includes a plurality of numeral wheel windows symmetrically located in the corner section of each of the two housing halves.

* * * * *